US012049341B1

(12) United States Patent
Vukkisila

(10) Patent No.: US 12,049,341 B1
(45) Date of Patent: Jul. 30, 2024

(54) REMOVABLE SECURE LID AND TAPERING WALL TRAY

(71) Applicant: Suresh Vukkisila, Roseville, CA (US)

(72) Inventor: Suresh Vukkisila, Roseville, CA (US)

( * ) Notice: Subject to any disclaimer, the term of this patent is extended or adjusted under 35 U.S.C. 154(b) by 213 days.

(21) Appl. No.: 17/122,676

(22) Filed: Dec. 15, 2020

Related U.S. Application Data

(60) Provisional application No. 62/948,931, filed on Dec. 17, 2019.

(51) Int. Cl.
*B65D 1/34* (2006.01)
*B65D 43/02* (2006.01)

(52) U.S. Cl.
CPC ..... *B65D 1/34* (2013.01); *B65D 43/0212* (2013.01); *B65D 2543/00833* (2013.01)

(58) Field of Classification Search
CPC ..... B65D 43/0212; B65D 1/34; B65D 2543/00833; A47J 36/10
USPC ..... 220/326, 324, 323, 315
See application file for complete search history.

(56) References Cited

U.S. PATENT DOCUMENTS 1,676,868 A * 7/1928 Petersen ..... B65D 43/0212 220/281
2009/0223967 A1* 9/2009 Mengeu ..... B65D 50/046 220/793
2012/0043336 A1* 2/2012 Grider ..... A47J 36/10 220/573.1
2013/0175284 A1* 7/2013 Chen ..... B65D 43/0208 220/780
2019/0135478 A1* 5/2019 Appendini ..... A45C 11/20
2020/0407920 A1* 12/2020 Chung ..... B65D 1/42

* cited by examiner

*Primary Examiner* — Jeffrey R Allen
(74) *Attorney, Agent, or Firm* — Heisler & Associates

(57) ABSTRACT

A tray includes a floor with walls extending both upwardly and outwardly from said floor to upper edges defining a perimeter. In one embodiment, the walls include opposing side walls and opposing end walls. A lid overlies the tray. The lid includes a perimeter which is similar in size to the tray perimeter. The lid includes latches with upper portions which are spaced apart a greater distance than a width of the tray, and with portions below the upper portions which are closer to each other than the width of the tray. In one embodiment, flanges extend from lower portions of the latches both downwardly and away from the center of the lid. The latches can include knobs extending toward the tray and the walls of the tray can include notches adjacent to the knobs, with the knobs extending into the notches to help secure the lid to the tray.

17 Claims, 3 Drawing Sheets

REMOVABLE SECURE LID AND TAPERING WALL TRAY

CROSS-REFERENCE TO RELATED APPLICATIONS

This application claims benefit under Title 35. United States Code § 119(e) of U.S. Provisional Application No. 62/948,931 filed on Dec. 17, 2019.

FIELD OF THE INVENTION

The following invention relates to trays such as food service trays and removable lids for covering such trays. More particularly, this invention relates to trays with lids which are securely but removably attached to the underlying trays.

BACKGROUND OF THE INVENTION

Food items are often beneficially placed upon a tray, plate or other underlying support in a manner which benefits from having a lid overlying such a tray. Such a lid keeps the food items fresh, such as by slowing down dehydration, keeping flying insects and other pests from coming into contact with the food, and otherwise keeping the food in a fresh state longer than if no lid is provided. Such lids also allow for multiple trays of food to be stacked vertically, without crushing or otherwise damaging the food items.

Often it is desirable for the food items to be visible when placed upon such a tray and when covered with such a lid. To facilitate visibility of the food items, the lid is beneficially formed of a transparent material. Examples where it is desirable to have a transparent lid include when the food items are being offered for sale, so that potential purchasers can view the food items without needing to leave the food items uncovered and without requiring lid removal for purchase or inspection of the food items. Additionally, it is generally desirable for food items to be visible in outdoor buffet settings, as those invited to the buffet can enjoy the pleasing appearance of the food items before the buffet is open, and the lids can keep the food fresh before the buffet is open as well.

Food trays and lids are known to be made from plastic type materials. A tray formed of plastic and a lid formed of plastic can have complementarily formed rims which allow the lid to snap onto the tray, in at least some plastic food containment arrangements. Some plastics are known to have some degree of biodegradability and compostability. Generally, such degradable plastic materials avoid degradation before coming into contact with moisture, but begin to decompose when coming into contact with moisture. Some plastics decompose more rapidly than others. Generally when the priority is to maximize compostability and decomposition, materials rapidly decompose when coming into contact with moisture. When high strength maintenance is desired in a variety of environments, including high humidity environments and rain exposure environments is a priority, plastics can be selected with a slower rate of decomposition after coming into contact with water and other liquids. Because heat is also a factor in decomposition rates, and because food items are often served warm, and many items also have a high moisture content, a readily compostable/biodegradable plastic tray has a higher propensity to lose structural strength and to begin premature decomposition, then a lid formed of less readily biodegradable/compostable materials. The lid may come into contact with moisture and some heat, such as through condensation processes, but the heat is significantly less because the lid is not in direct contact with the hottest surfaces of heated food items.

One solution to providing a tray and lid which are readily and highly biodegradable and compostable, while still facilitating display of the food items is to utilize a cellulosic material for the tray and to utilize a readily biodegradable/compostable clear plastic lid. As an example, it is known to utilize pressed palm leaf material to form a relatively flat dish or tray. It is also known to provide a lid which can rest upon a lip of such a dish/tray of cellulosic material. Pressed palm leaf material, while highly effective, is generally less strong than trays formed of thin sheets of wood or plywood. Also, trays formed of wood can generally be constructed to have a greater depth, as they are typically made out of separate planar layers fastened together in a manner which provides tray height dimension, rather than the materials being pressed and molded into a shape which forms the tray height dimension. Thus, utilizing wood sheet cellulosic material rather than pressed palm leaf or other pressed cellulosic material is generally desirable when greater depth and higher strength is desired, such as for carrying a large and heavy display of food items. Furthermore, wood grain from planar sheets of wood has a distinctive appearance relative to a pressed palm leaf appearance, and different consumers of serving equipment formed of cellulosic material may have a preference for the aesthetics of one cellulosic material over another.

Lids which rest upon larger trays, as provided in the prior art, have multiple drawbacks. The larger lids can often have insufficient strength to allow for stacking of trays filled with food upon such lids. This is because the lids have perimeter edges which are pushed laterally outwardly when forces are applied from above, and the lateral edges of such lids are not secured to the underlying tray, but only rest upon such a tray, so that no lateral stability is provided to better carry vertical loads. Furthermore, lids which merely rest upon a tray can become easily dislodged when bumped.

While trays formed of planar wooden sheets have a fairly uniform size and shape, some variation can occur, especially when the materials are exposed to differences in moisture, temperature and solar radiation. Thus, lids configured to attach to trays formed of planar wooden sheet material benefit from being able to accommodate such a variation. Also, trays which have a geometry featuring highly tapering side walls, and especially without a laterally extending rest surface, can be difficult for lids to attach thereto. Accordingly, a need exists for an improved lid for use with wooden food serving trays.

SUMMARY OF THE INVENTION

With this invention, a removable secure lid is provided for a tray having tapering walls, and especially for trays formed of sheets of planar wood material. While such trays could have a variety of different geometries, in one embodiment, the tray is rectangular or square, and has a flat planar floor. Walls of the tray taper up from the lower edges of the floor at an angle, such as 45°, away from horizontal. This angle could be somewhat shallow or steeper, such as between 30° and 60°, or perhaps as low as 15° or as high as 75° (or even up to 90°), in some embodiments. Upper edges of the walls optionally do not have any laterally outwardly extending rest (or lip) structure. Rather, a terminating upper edge of such a wall typically has a width similar to a thickness of the planar sheet of wood material forming the wall and floor and defining a tray perimeter.

In other embodiments, the tray could be circular or oval or rectangular but with rounded corners, especially when formed of pressed cellulosic material or when carved from a monolithic block of cellulosic material, rather than being formed of planar sheets of cellulosic material. Various different facets of a tray formed of planar sheet material could be bonded together by glue or other adhesive, or could be attached together with fasteners (or be formed to fasten together somewhat like a jigsaw puzzle) to hold the planar sheets of material together. The trays can also be formed to be collapsible, such as for more compact storage before use.

Transparent plastic lids are typically attached to underlying trays by having the tray fitted with a lateral extending rest (or lip) at an upper edge of side walls thereof. The lid then has an inwardly extending groove sized to snap over this rest and to hold the groove to the rest and secure this lateral edge of the lid to such a laterally extending rest on the tray. With the tray as described above, and without such a lateral extending rest (or lip), such a lid construction is not effective for attachment. While the lid could merely have a laterally extending step which is set upon the upper edge of the side walls so that the lid rests upon the upper edge of the sidewall through such a step, such an arrangement does not involve securing and fastening, but rather having a lid only resting upon the tray. As described in detail above, without secure fastening, the lid is more prone to becoming dislodged and cannot carry as much weight, such as from stacking of multiple trays (with lids) upon each other.

With this invention, a lower lateral edge of the lid is provided with both a lip (also called a rest surface) on at least portions of this lid perimeter, and a series of latches extending downwardly and inwardly from the perimeter of the lid. This latch initially extends at an angle preferably matching an angle of the wall of the tray. So if the tray extends at a 45° angle, the latch extends downwardly and inwardly from the lip at a 45° angle, so that when the lip is resting upon an upper edge of the wall of the tray, the latch is parallel with the wall of the tray and extending down toward the floor of the tray (but on an exterior surface of the wall, rather than on an interior surface).

Most preferably, a series of latches are provided onto opposing sides of a rectangular or square tray. In one embodiment, the tray is approximately twice as long as it is wide and with two latches on each end, with the four latches in pairs spaced apart by the longest dimension of the tray. The lid otherwise generally matches dimensions of the tray. Lateral sides of the lid can be provided with latches as well. In one embodiment, the lateral sides do not have latches, but they do have a skirt which extends down from a perimeter lip/rest surface, just past an outwardly extending upper edge perimeter of the tray, and to keep the lid aligned on the tray, and from sliding laterally off of the tray. As few as one latch could be provided on each side of the lid that includes any latches. In one embodiment, one large latch can be provided which has a size generally matching a dimension of the side upon which the latch is located.

A lower end of the latch preferably includes a flange extending (perpendicularly as one option) from upper portions of the latch in a downward and outward direction. This flange can be flat or can be curved, such as to include a finger curl at a distal tip of the flange, and for this flange to be more readily grasped by fingers of a user to apply an upward and outward force to the flange, allowing the latch to be opened and to allow for the lid to be lifted up off of the tray. In one embodiment, the latch secures to the tray merely because the latch is oriented parallel with the wall of the tray and the wall of the tray tapers at a sufficient angle so that the latch holds the perimeter edge of the lid on the tray.

Most preferably, and to further facilitate secure positioning of the latch of the lid relative to the tray, the tray is provided with strategically placed notches extending into the walls on an exterior thereof. These notches can extend into the wall or entirely through the wall, as an option. The latch preferably has a knob extending inwardly from a surface of the latch. This knob is sized to fit into the notch somewhat, and further helps to register and secure the latches relative to the walls, so that the lid is precisely placed where desired. The latch knob can be provided along with other geometric structures of the latch when the lid is originally formed. In one embodiment, the lid is formed by a molding process, such as blow molding or vacuum forming, and the latches have sufficient flexibility to allow the latch structure to be disengaged from mold elements, after molding has occurred.

The lid also includes a dome in one embodiment thereof, so that central portions of the lid extend upwardly as they extend away from this lateral edge and toward the center of the lid. This dome could be a continuous curve, or could have a taper near lateral edges thereof and then transition into a flat central portion. When transitioning into a flat central portion, the lid can particularly accommodate other trays resting upon such a lid. A top flat centered plateau on the lid can have a rib extending upwardly at a perimeter thereof, strategically located (and shaped with a tray floor perimeter matching contour) so that this rib surrounds a space which is sized and shaped similar to a size and shape of a floor of a tray to which the lid is configured to attach. In this way, when a tray is placed upon this central plateau of the lid, the floor of the tray rests inboard of this rib and the tray is caused to be held precisely were desired, centrally located upon the central plateau of the lid. Thus, multiple trays with lids can be stacked vertically and be held together somewhat by these ribs, and to more efficiently allow for stacking of trays and lids, especially with food items contained therein.

Because the latches extend downwardly and inwardly below walls and upper edges of walls of the tray, and with the knob on the latch extending somewhat into the notches, perimeter edges of the lid resist splaying outwardly and associated collapsing of the top plateau of the lid. Such a structural reinforcement allows the lid to carry a greater amount of weight than would otherwise be the case.

While example embodiments have been disclosed above, other embodiments are also disclosed herein. Further examples are provided, both in this written description and in included figures illustrating the exemplary embodiment and other embodiments. As various examples, the dome portion of the lid could be replaced with a flat lid or with a recessed lid, with the recessed lid extending down into an interior of the tray somewhat, and the flat lid being co-planar with upper edges of the side walls of the tray. The flange on the latch can be either flat or curved, such as with a finger curl. Angling of the flange relative to the latch can be perpendicular or can be of a greater or lesser amount. While the latch has an undercut to extend under the sidewall of the tapering wall tray somewhat, the latch does not need to be parallel with the wall of the tray, but could have some other amount of undercut and still function somewhat similar to embodiments disclosed above.

OBJECTS OF THE INVENTION

Accordingly, a primary object of the present invention is to provide a lid and tray combination with the lid removably secured over the tray.

Another object of the present invention is to provide a lid which can removably attach to a wooden tray and especially a tray without a perimeter lip.

Another object of the present invention is to provide a lid which can attach to a tray even if the dimensions of the tray do not hold to tight tolerances.

Another object of the present invention is to provide a plastic lid for removable attachment to a wooden tray to keep flying pests from accessing food or other contents located upon the tray.

Another object of the present invention is to provide a transparent lid for attachment to a disposable food service tray, which lid allows food items to be viewed, but keeps the food items protected from unwanted contact.

Another object of the present invention is to provide a tray which includes latching features thereon which can cooperate with latching features of a lid for secure but removable attachment of a lid thereto, and to facilitate stacking of trays upon the lids with manual lid deflection.

Another object of the present invention is to provide a method for removable attachment of a lid to a tray.

Other further objects of the present invention will become apparent from a careful reading of the included drawing figures, the claims and detailed description of the invention.

DESCRIPTION OF THE PREFERRED EMBODIMENT

Figure 1:
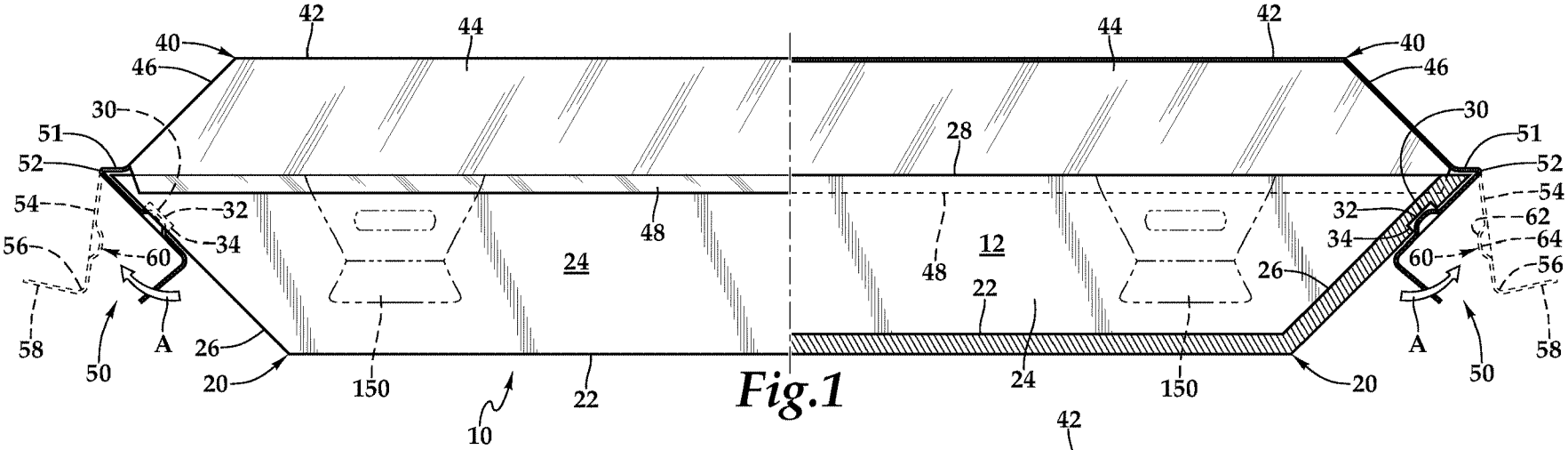
FIG. 1 is a front elevation view of a tray and lid according to this invention with a left half of FIG. 1 shown in section and with optional sidewall latches shown in broken lines.

Referring to the drawings, wherein like reference numerals represent like parts throughout the various drawing figures, reference numeral 10 is directed to a food enclosure according to various embodiments of this invention, providing a removable secure lid 40 for attachment to a tapering wall tray 20 according to this invention (FIGS. 1, 4, 5 and 8). The lid 40 both rests upon and attaches to the tray 20 through latches 50 to removably secure the lid 40 to the tray 20.

Figure 8:
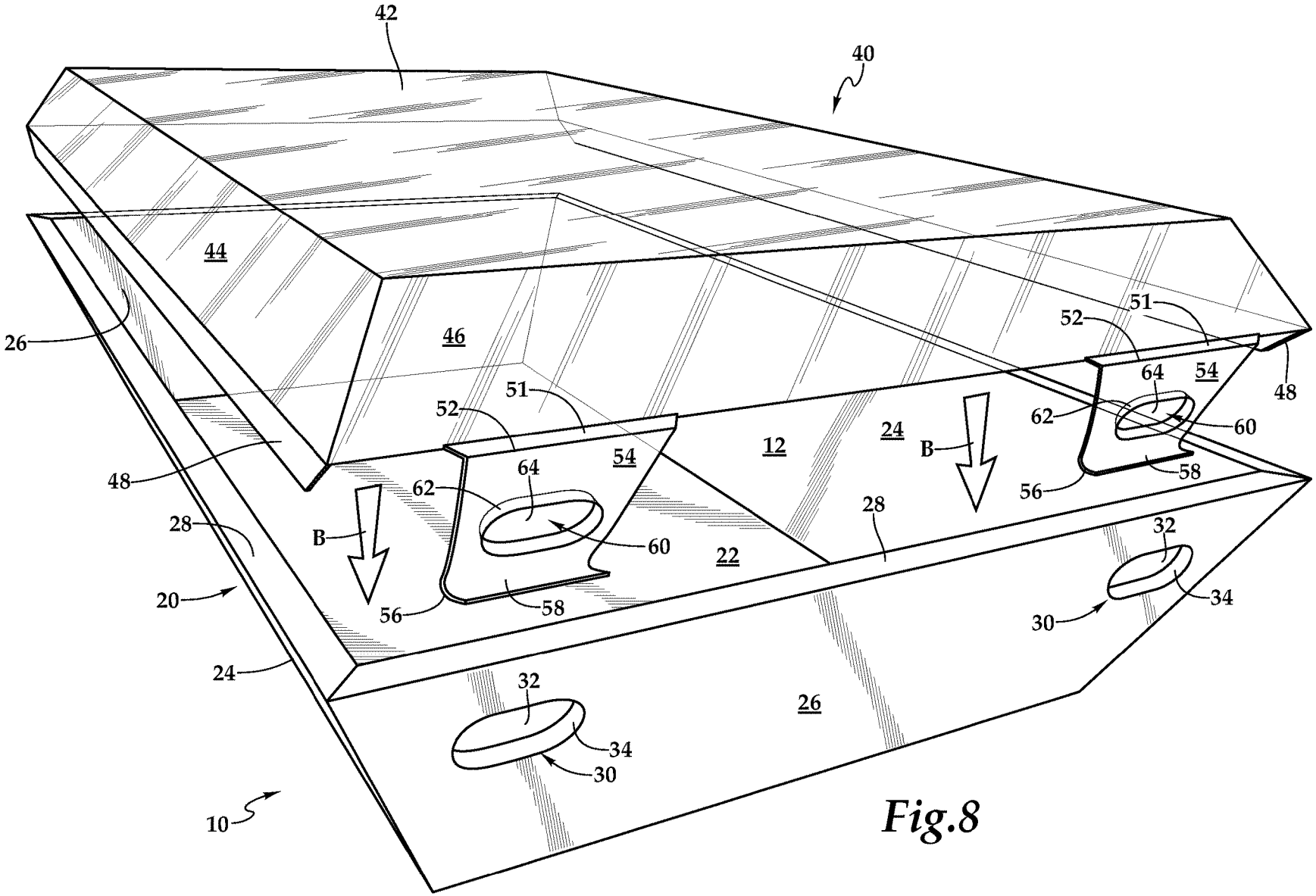
FIG. 8 is a perspective view of that which is shown in FIG. 1.

In essence, and with particular reference to FIGS. 1 and 8, basic details of the food enclosure 10 are described, according to one embodiment. The tray 20 includes a floor 22 of planar form with walls such as side walls 24 and end walls 26 tapering upwardly from lower edges at the floor 22 to upper edges 28 together defining a perimeter of the tray 20. Notches 30 can be formed in the end walls 26 (and other locations) to assist in securely holding the lid 40 upon the tray 20. The lid 40 is sized to span and overlie the tray 20 with a perimeter of the lid 40 similar in size but slightly greater than a perimeter of the tray 20, or at least portions of the lid 40, so that the lid 40 rests upon the tray 20. Latches 50 are provided on a perimeter of the lid 40 which extend around the upper edges 28 of the tray 20 and inwardly a sufficient distance to underlie portions of the upper edges 28 of the tray 20 and hold the lid 40 upon the tray 20. The latches 50 are sufficiently flexible that they can be flexed to be wider than the upper edges 28 of the tray 20, for removal of the lid 40. Knobs 60 can extend from the latches 50 and into the notches 30 in the tray 20 to further secure the lid 40 to the tray 20 through the latches 50.

Figure 3:
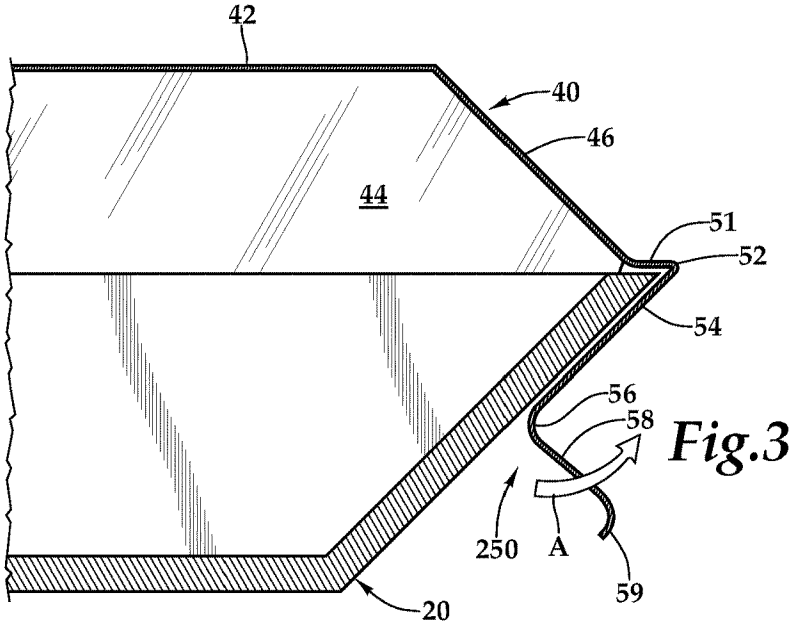
FIG. 3 is a front elevation view of an alternative embodiment of that which is shown in FIG. 1 at a right side thereof, and illustrating a latch which is knob-less and being used with a tray which is notch-less.
Figure 5:
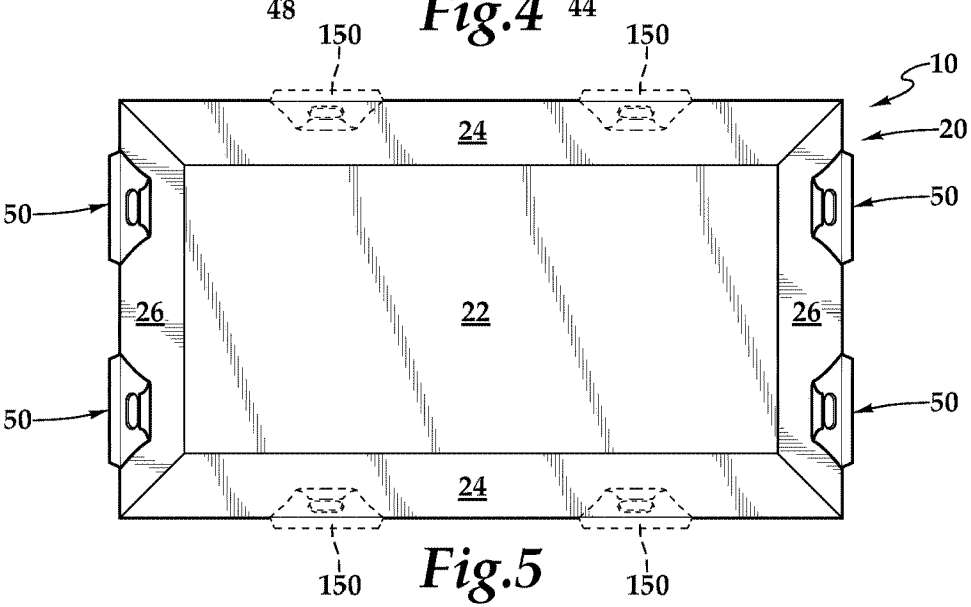
FIG. 5 is a bottom plan view of that which is shown in FIG. 1 and illustrating how four latches can be provided at ends of the tray and lid combination in one embodiment, and with optional side latches shown in broken lines.

More specifically, and with continuing reference to FIG. 1 as well as FIGS. 3, 5 and 8, particular details of the tray 20 are described, according to one typical embodiment. The tray 20 is a substantially rigid structure with the floor 22 underlying an open interior 12 space of the enclosure 10. The tray 20, in one embodiment, includes opposing side walls 24 extending upwardly and outwardly from sides of a lower edge of the floor 22. End walls 26 extend upwardly and outwardly from ends of the lower edge of the floor 22, with the end walls 26 opposing each other and located between the two side walls 24. Preferably the end walls 26 are perpendicular to the side walls. Preferably, the side walls 24 taper outwardly as they extend upwardly at a similar angle to that which the end walls 26 taper outwardly. In one embodiment, this angle of taper is 45° away from vertical. In other embodiments, this angle could be greater or less. The walls 24, 26 could curve somewhat, such as with a gradual bending at their junction with the floor 22. Most preferably, the walls 24, 26 have at least some taper away from vertical, so that the latches 50 can extend under the upper edges 28 of the walls for securing of latches 50 to the tray 20, without necessarily requiring the notches 30 and knobs 60 (described in detail below). However, in one embodiment the walls 24, 26 can be vertical (or near vertical) and the latches 50 can hold to the tray 20 primarily (or entirely) through action of the knobs 60 extending into the notches 30.

The side walls 24 are typically larger than the end walls 26. However, these walls 24, 26 could be similar in size, such as if the tray 20 were provided with a square floor 22 and a square upper edge 28 defining a perimeter of the tray 20. As a further option, the floor 22 could be square (or rectangular) but the side walls 24 and end walls 26 could have different angles so that the upper edges 28 defining a perimeter of the tray 20 could be rectangular (or square). In other embodiments, a greater or lessor number than four walls could be provided on the tray 20, such as if the tray 20 were triangular, pentagonal, hexagonal, or otherwise provided with different numbers of walls.

Figure 6:
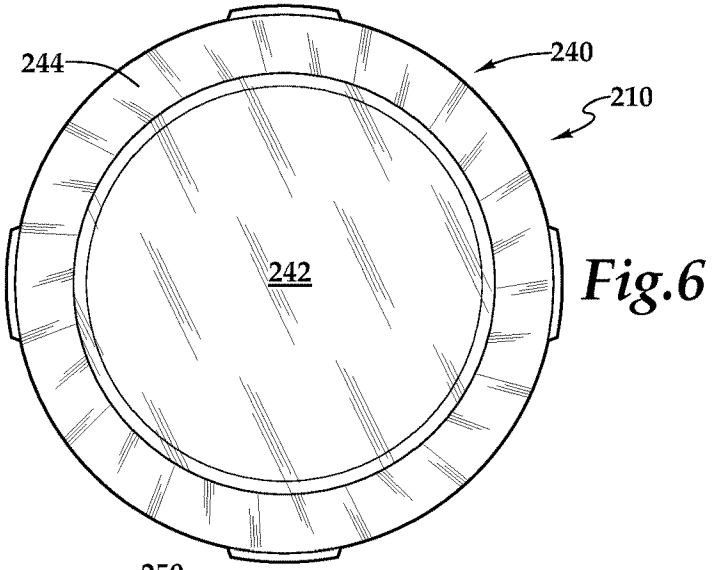
FIG. 6 is a top plan view of a circular embodiment of tray and corresponding lid, according to an alternative embodiment of this invention.
Figure 7:
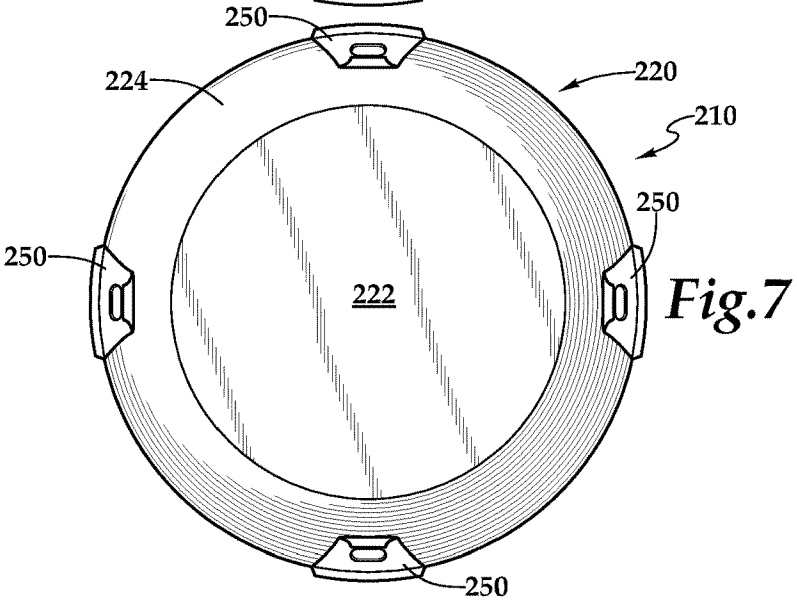
FIG. 7 is a bottom plan view of that which is shown in FIG. 6.

In one embodiment disclosed in FIGS. 6 and 7, a round food enclosure 210 is disclosed which includes a round tray 220 with a round floor 222 and conical side walls 224 extending upwardly and outwardly from this round floor 222. The round food enclosure 210 also includes a round lid 240 which, in one embodiment, includes a central flat 242 of circular form and a conical facet 244 extending downwardly from the central flat 242, and with a series (with four being one example) of latches 250 (having a slight arcuate curving form) holding the lid 240 onto the tray 220. Such a round food enclosure 210 thus provides an alternative embodiment to the tray 20 disclosed in FIGS. 1, 5 and 8.

Upper edges 28 of the tray 20 preferably have a certain width between the interior 12 and an exterior of the tray 20, which presents the surface upon which portions of the lid 40 can rest. This thickness/width of the upper edges 28 varies depending on a thickness of the tray 20. Most preferably, the tray 20 has a substantially uniform thickness, such as (in one embodiment) ⅛ inch. In one embodiment, the tray 20 is formed of wood. The floor 22 would be provided from one planar piece of wood, and two side walls 24 and two end walls 26 would be provided from four other pieces of wood. An adhesive would be utilized to join the floor 22 and walls 24, 26 together. As an alternative, the tray could be formed in other manners, such as by pressing the tray 20 from one or more thinner layers of wood or other cellulosic material and then bonding the layers together in a laminate fashion (either with a bonding agent or with mere heat and pressure (and perhaps steam) applied to shape and bond the layers together. The tray 20 could be formed of other materials in other embodiments, such as injection molded plastic, blow molded plastic, vacuum formed plastic, or from other moldable materials, or by machining from wood or other materials into the final desired shape, such as the shapes described and disclosed herein.

The tray 20 includes notches 30 in one embodiment on an exterior of at least some of the walls 24, 26 of the tray 20, and typically at least two notches 30 on two opposing portions of the tray 20. In the embodiment disclosed in FIG. 5, two notches would be provided in each of the end walls 26 (note that these notches 30 are covered by the latches 50 in FIG. 5 so that they cannot be seen in FIG. 5, but they are shown in FIG. 8). The notches 30 are best shown in FIG. 8, and also shown in FIGS. 1 and 2.

The notches 30 could extend entirely through the end walls 26 (or other walls), but preferably only extend partially into an exterior surface of the end walls 26 to a flat 32. A step 34 surrounds the flat 32 and defines a depth of the notches 30. In one embodiment, the notches 30 are milled into the exterior surface of the end walls 26. The notches 30 can have a variety of different shapes, with one shape being oval, similar to as shown in FIG. 8. Preferably, the two notches 30 are close enough together so that a user can, with a single hand, reach areas adjacent to each of the notches 30, so that a pair of latches 50 overlying the notches 30 can both be accessed at the same time with a single hand, so that the latches 50 on opposing ends of the lid 40 and tray 24 can be opened by hand to allow for removal of the lid 40 from the tray 20.

Figure 4:
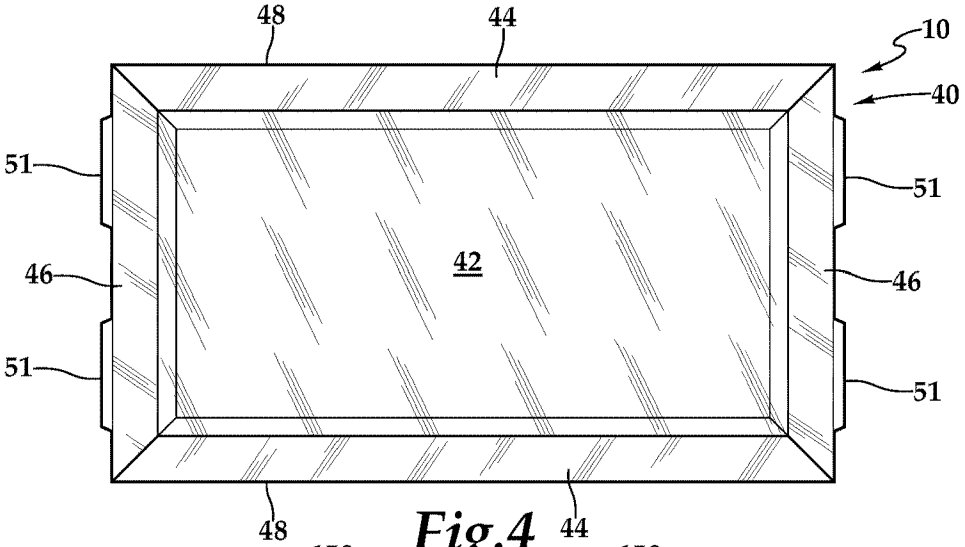
FIG. 4 is a top plan view of that which is shown in FIG. 1, and with the lid being at least partially transparent so that some details of an interior of the underlying tray can be seen therein.

With continuing reference to FIGS. 1 and 8, as well as FIGS. 4 and 5, details of the lid 40 are described, according to one embodiment. The lid 40 extends over the interior 12 of the enclosure 10 to completely cover the tray 20 in a most preferred embodiment. The lid 40 protects the interior 12 from flying pests and other contact, such as inadvertent contact by hands of various different individuals. In this way, food upon the tray 20 can be protected from contamination. Furthermore, and if food items are decorative or fragile in nature, the lid 40 protects the food items from damage by contact. The lid 40 also allows for stackability of food enclosures 10, without contacting food items upon the trays 20.

In the embodiment disclosed, each lid 40 includes a central flat 42 with a pair of side facets 44 extending downwardly and outwardly from the central flat 42 on opposing sides of the central flat 42, and with end facets 46 extending downwardly and outwardly from the central flat 42 as well. The end facets 46 are located opposite each other and between the side facets 44. In one embodiment, the end facets 46 and side facets 44 cause the lid 40 to have a shape somewhat similar to that of the tray 20, but inverted.

If desired, a rib can extend up from a perimeter of the central flat 42 to act as a curb to help to keep the floor 22 of the tray 20 resting upon the lid 40 when food enclosures 10 are stacked vertically. The lid 40 is typically formed of an at least partially transparent material, such as injection moldable plastic or blow moldable plastic or vacuum formed plastic, to have the shape desired. The plastic forming the lid 40 also preferably forms the latches 50 and has sufficient flexibility, either due to a nature of the material or a thickness of the lid 40 between inner and outer surfaces thereof, that the latches 50 can flex significantly without breaking (such as at least 45° at pre-formed corners, along arrow A of FIGS. 1-3).

The lid 40 is sized and shaped to work with a particular tray, such as the tray 20. If a shape and/or size of the tray 20 is modified, the lid 40 would typically be modified in a corresponding fashion, especially so that a perimeter defined by lower portions of the facets 44, 46 remains corresponding in size to the upper edges 28 defining the perimeter of the tray 20. Other details besides these joining surfaces of the tray 20 and lid 40 could vary more significantly in various different embodiments and still allow lids 40 of a variety of different shapes to attach to trays 20 of a variety of different shapes.

Most preferably, lower edges of the facets 44, 46 terminate at a rest surface 51 (also called a lip) which extends substantially horizontally. In one embodiment, this rest surface 51 is only provided where the latches 50 are also provided. In other embodiments, an entire perimeter of the lid 40 includes such a rest surface 51. An outer edge of the rest surface 51 is preferably wider than corresponding portions of the tray 20, so that the latches 50 can extend down beneath upper portions of the walls 24, 26 of the tray 20. Inner edges of the rest surface 51 preferably define a width of the lid 50 being between inner and outer portions of the upper edges 28 defining the perimeter of the tray 20. In this way, the rest surface 51 at least partially overlaps with the upper edges 28 of the tray 20 so that the lid 40 can rest upon the tray 20 and so that the lid 40 does not end up resting entirely inboard of the upper edges 28 or entirely outboard of the upper edges 28. Most preferably, a skirt 48 extends downwardly from outer portions of the rest surface 51, especially on portions of the lid 40 which did not include the latches 50 thereon. The skirt 48 helps to align the lid 40 upon the tray 20, such as on the side walls 24, when the latches 50 are limited to only being located on the end facets 46 of the lid 40.

The latches 50 are preferably formed with the lid 40 and extend inwardly and downwardly from an exterior portion of the rest surface 51. Each latch 50 includes an upper corner 52 defining where the latch 50 joints to the rest surface 51. An upper plate 54 extends downwardly and outwardly from this upper corner 52. The size of the upper plate 54 is sufficient so that significant portions of the upper plate 54 extend beneath the upper edges 28 at the end walls 26 of the tray 20. The latch 50 could conceivably end with just the upper corner 52 and the upper plate 54. Most preferably, a lower corner 56 is provided at a lower portion of the upper plate 54, with the lower corner 56 transitioning the latch 50 into a flange 58. The flange 58 preferably extends downwardly and away from the center of the lid 40. In one embodiment, the flange 58 is perpendicular to the upper plate 54. A finger curl 59 can optionally be provided at a distal edge of the flange 58 which curves downwardly slightly and allows for a finger of a user to grip under the finger curl 59 and conveniently apply a rotating force (along arrow A FIGS. 1-3) to flex the latches 50 outwardly (broken lines in FIG. 1) to allow for removal of the lid 40 (in an upward direction opposite that represented by arrow B in FIG. 8).

With particular reference to FIG. 3, a knob-less latch 250 is shown. This latch 250 merely retains the lid 40 to the tray 20 because of the angled orientation of the upper plate 54, to allow for securing of the lid 40 upon the tray 20. In the embodiments depicted in FIGS. 1-5, latches 50 are only provided at ends of the food enclosure 10 corresponding with the end walls 26 of the tray 20 and end facets 46 of the lid 40, and provided with a pair of latches 50 at each end. As an option, side latches 150 can be provided (such as depicted in FIGS. 1 and 5 in broken lines). The side latches 150 could be provided as an alternative to the latches 50 provided at the ends of the food enclosure 10, or with a combination of both the latches 50 and the side latches 150.

In one embodiment, a recessed lid 140 is provided (FIG. 2) which does not have a domed form overlying an interior 12 of food enclosure 10. Such a recessed lid 140 could be flat, so that the central flat 42 essentially extends all of the way to a perimeter of the recessed lid 140 in the form of a central recessed flat 142, and then could extend up at a curb 144 to transition into the rest surface 51 and latches 50. The curb 144 assists in stacking of other food enclosures 10 upon such a recessed lid 140.

Figure 2:
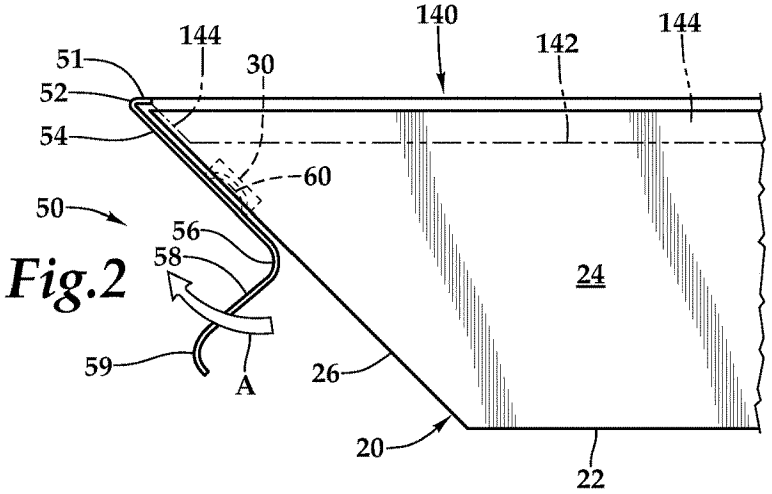
FIG. 2 is a front elevation view of an alternative embodiment of that which is shown in FIG. 1, at a left side thereof, and illustrating a flat or slightly recessed lid option and a latch including a finger curl at a distal tip of a flange of the latch on the lid.

In one embodiment, the flanges 58 are slightly longer than those depicted in FIGS. 1-3 so that the lowermost edges of the flanges adjacent to the finger curls 59 (if the finger curls 59 are provided) are located further apart than the width of the tray 20 defined by the upper edges 28 of the end walls 26. In such a configuration, the lid 40 can move downward (along arrow B of FIG. 8) and will come into contact with the tray 20 when the lower portions of the flanges 58 contact the upper edges 28 of the tray 20. Because of the angle of the flanges 58 both downwardly and outwardly, the lid 40 can merely be pressed downwardly and the latches 50 will be caused to automatically pivot outwardly (along arrow A of FIGS. 1-3). Downward pressure on the lid 40 (along arrow B of FIG. 8) in a continuing fashion will cause the latches 50 to continue to open (along arrow A of FIGS. 1-3), until the upper plates 50 for the latches 50 are substantially vertical (at least enough to accommodate lid 40 attachment). The lid 40 further moving down (along arrow B of FIG. 8) will have the latches 50 snap down onto the upper edges 28 of the tray 20, so that the lid 40 can have a snap-on characteristic for attachment to the tray 20, without requiring multiple hands to open the latches 50 (along arrow A) for attachment to the tray 20. For removal of the lid 40 from the tray 20, fingers would grip the flanges 58 (such as just inboard of the finger curls 59 if the finger curls 59 are provided) and outward lateral forces are provided to open the latches 50 sufficient to allow the lid 40 to be lifted up off of the tray 20 (in the direction opposite that of arrow B in FIG. 8).

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A lid and tray enclosure, comprising in combination:

a tray having a planar floor and a plurality of upwardly tapering walls;

said walls extending from a lower edge adjacent to said floor to an upper edge;

a lid having a perimeter which extends both downwardly and outwardly to a perimeter;

at least two latches located on opposing portions of said lid perimeter, said latches including portions which extend downwardly and inwardly;

at least portions of said perimeter of said lid sized larger than said tray at said upper edge of said walls;

said latches having portions thereof which are spaced apart from each other by a distance less than spacing between opposing upper edges of said walls of said tray:

said latches being sufficiently flexible to flex outwardly to have all portions of said latches spaced apart by a distance at least as great as spacing between upper edges of said walls of said tray, such that removal of said lid off of said tray is facilitated:

wherein at least one of said latches includes a flange at a lower edge thereof, said flange extending outwardly and downwardly relative to an adjacent one of said latches;

said latches shaped and positioned to be adjacent to said walls of said tray when said lid is located upon said tray; and wherein when said lid is located upon said tray, said at least one flange extends away from said walls of said tray as said at least one flange extends downwardly and outwardly relative to said adjacent one of said latches.

2. The enclosure of claim 1 wherein said flange includes a finger curl at a distal end thereof, said finger curl extending at least partially downwardly relative to said center of said lid.

3. The enclosure of claim 1 wherein said lid includes a lip extending horizontally at said perimeter of said lid and above said latch, said lip having portions thereof located inboard of said upper edges of said walls of said tray and portions of said lip having a width greater than a width of said tray at said upper edges of said walls.

4. The enclosure of claim 3 wherein said lid includes a dome extending upward from said lip.

5. The combination of claim 4 wherein said dome includes a central planar flat providing at least a central portion of said lid.

6. The combination of claim 1 wherein said latch includes a knob extending inwardly therefrom.

7. The combination of claim 6 wherein at least two of said walls of said tray include at least one notch therein, said notches sized and located to receive said knobs of said latches therein when said lid is placed upon said tray.

8. The combination of claim 1 wherein said lid is at least partially transparent.

9. The combination of claim 1 wherein said tray is formed of cellulosic material.

10. The combination of claim 9 wherein said tray is formed of planar sheets of wood joined together.

11. A food enclosure, comprising in combination:

a tray having a floor surrounded by walls extending up from the floor to an upper edge;

said walls tapering at least partially laterally as said walls extend up from said floor, with said upper edge of said walls together having a larger perimeter than a perimeter of said floor;

a lid overlying said tray;

said lid including at least two latches on opposing portions of said lid;

said latches formed of a common material with said lid;

said latches having upper portions spaced apart a greater distance than a width of said perimeter of said tray, and portions of said latches below said upper portions which are spaced apart a lesser distance than said width of said perimeter of said tray;

wherein at least one of said latches includes a flange located below said upper portions of said at least one latch, said flange extending downwardly and outwardly relative to an adjacent one of said latches;

said latches shaped and positioned to be adjacent to said walls of said tray when said lid is located upon said tray; and wherein when said lid is located upon said tray, said at least one flange extends away from said walls of said tray as said at least one flange extends downwardly and outwardly relative to said adjacent one of said latches.

12. The enclosure of claim 11 wherein said lid is at least partially transparent.

13. The enclosure of claim 11 wherein said at least two latches include knobs thereon extending toward said tray when said lid is located upon said tray, said tray including notches aligned with said knobs when said lid is placed upon said tray, said notches at least as large as said knobs, such that said knobs reside at least partially within said notches when said lid is located upon said tray.

14. The food enclosure of claim 13 wherein said tray includes a pair of opposing side walls and a pair of opposing end walls, said side walls larger than said end walls, each of said end walls including a pair of notches thereon, said notches formed on an outer surface of said end walls, and wherein said lid includes a pair of latches on a first side of said lid and a pair of latches on a second side of said lid opposite said first side of said lid.

15. The food enclosure of claim 11 wherein a distal tip of said flange includes a finger curl thereon which curls downwardly from said flange.

16. The food enclosure of claim 14 wherein at least portions of said perimeter of said lid include a substantially horizontal rest surface, said rest surface having at least portions thereof sized to rest upon said upper edge of said walls of said tray.

17. The food enclosure of claim 16 wherein said lid includes a skirt extending downwardly from an outer edge of said rest surface on at least portions of said lid, said skirt located outboard of said upper edge of said tray when said lid is resting upon said tray.

* * * * *